US008550866B2

(12) United States Patent
Wadhwani

(10) Patent No.: US 8,550,866 B2
(45) Date of Patent: Oct. 8, 2013

(54) INVERTIBLE PILLOW OR CUSHION

(76) Inventor: Chandru H Wadhwani, Anaheim, CA (US)

( * ) Notice: Subject to any disclaimer, the term of this patent is extended or adjusted under 35 U.S.C. 154(b) by 322 days.

(21) Appl. No.: 13/069,242

(22) Filed: Mar. 22, 2011

(65) Prior Publication Data

US 2012/0238178 A1 Sep. 20, 2012

Related U.S. Application Data

(60) Provisional application No. 61/452,371, filed on Mar. 14, 2011.

(51) Int. Cl.
*A63H 3/02* (2006.01)

(52) U.S. Cl.
USPC ..... 446/72; 446/369

(58) Field of Classification Search
USPC ..... 446/71, 72, 73, 75, 76, 321, 337, 339, 446/369, 370, 371, 372, 385, 387, 388
See application file for complete search history.

(56) References Cited

U.S. PATENT DOCUMENTS

| | | | | |
|---|---|---|---|---|
| 4,614,505 | A * | 9/1986 | Schneider et al. | 446/372 |
| 4,695,264 | A * | 9/1987 | McLeod, Jr. | 446/321 |
| 4,734,075 | A | 3/1988 | Park | |
| 4,739,529 | A | 4/1988 | Mills | |
| 4,774,734 | A | 10/1988 | Mills | |
| 4,781,648 | A * | 11/1988 | Garfinkel | 446/321 |
| 4,842,565 | A * | 6/1989 | VonPhilp, Sr. | 446/321 |
| 4,856,131 | A | 8/1989 | Mills | |
| 5,088,139 | A * | 2/1992 | Bloom | 5/420 |
| 5,090,938 | A * | 2/1992 | Reynolds | 446/369 |
| 5,115,528 | A * | 5/1992 | Lamle | 5/640 |
| 5,172,440 | A * | 12/1992 | Ming | 5/485 |
| 5,713,741 | A | 2/1998 | DeMars | |
| 6,009,577 | A | 1/2000 | Day | |
| 6,106,360 | A | 8/2000 | Jenkins et al. | |
| 6,343,968 | B1 | 2/2002 | Louie et al. | |
| 7,000,274 | B2 | 2/2006 | Matthews Brown et al. | |
| 7,146,663 | B2 | 12/2006 | Brown et al. | |
| 7,367,070 | B2 | 5/2008 | Akkad | |
| 7,451,508 | B2 | 11/2008 | Matthews Brown et al. | |
| 7,730,564 | B2 | 6/2010 | Moore | |
| 7,810,191 | B2 | 10/2010 | Littlehorn et al. | |

(Continued)

FOREIGN PATENT DOCUMENTS

| | | |
|---|---|---|
| CN | 200720176158 | 6/2008 |
| CN | 201020101891 | 11/2010 |

(Continued)

OTHER PUBLICATIONS

Evaluation Report of Utility Model Patent issued by State Intellectual Property Office of the People's Republic of China issued on Dec. 3, 2012, in Chinese Application No. ZL201120239305X.

*Primary Examiner* — Nini Legesse
(74) *Attorney, Agent, or Firm* — LeonardPatel PC

(57) ABSTRACT

A textile product includes an external surface of a first form including a fastener that forms a first cavity when opened in the first form. The textile product also includes an internal surface of a second form that forms a second cavity when the fastener is opened in the second form. The textile product is invertible from the first form into the second form, and vice versa, via the first and second cavities, respectively.

20 Claims, 11 Drawing Sheets

(56) References Cited

U.S. PATENT DOCUMENTS

| | | | |
|---|---|---|---|
| 2003/0114074 | A1 | 6/2003 | Bart et al. |
| 2003/0216103 | A1 | 11/2003 | Blonder |
| 2004/0200004 | A1 | 10/2004 | Matthews Brown et al. |
| 2006/0057933 | A1 | 3/2006 | Bricker et al. |
| 2008/0115254 | A1 | 5/2008 | Galkov |
| 2010/0112892 | A1 | 5/2010 | LaPointe |

FOREIGN PATENT DOCUMENTS

| | | | |
|---|---|---|---|
| DE | 202007010700 | U1 | 11/2007 |
| GB | 2395430 | A | 5/2004 |
| JP | 10-230082 | | 9/1998 |
| JP | 2000-102683 | | 4/2000 |

* cited by examiner

INVERTIBLE PILLOW OR CUSHION

CROSS REFERENCE TO RELATED APPLICATIONS

This application claims priority of U.S. Provisional Patent Application No. 61/452,371, filed Mar. 14, 2011. The subject matter of this earlier filed application is hereby incorporated by reference in its entirety.

FIELD

The present invention generally relates to a pillow or cushion. More specifically, the present invention relates to a pillow or cushion that converts from one form into another when inverted.

BACKGROUND

Pillows that double as plush toys are generally known. For instance, plush toys exist that flatten into a pillow when Velcro® tabs are released. Plush toys also exist that convert into sleeping bags and backpacks.

SUMMARY

Certain embodiments of the present invention may provide solutions to the problems and needs in the art that have not yet been fully solved by conventional pillow toys. For example, certain embodiments of the present invention pertain to a pillow that converts from one form of the pillow into another when inverted.

In one embodiment, an apparatus includes an external surface of a first form including a first fastener that forms a first cavity when opened. The apparatus also includes an internal surface of a second form including a second fastener that forms a second cavity when opened. The apparatus is invertible from the first form into the second form, and vice versa, via the first and second cavities, respectively.

In another embodiment, an apparatus includes an external surface of a first form including a fastener that forms a first cavity when opened in the first form. The apparatus also includes an internal surface of a second form that forms a second cavity when the fastener is opened in the second form. The apparatus is invertible from the first form into the second form, and vice versa, via the first and second cavities, respectively.

In yet another embodiment, an apparatus includes an external surface of a first form including a fastener that forms a first cavity when opened in the first form. The apparatus also includes an internal surface of a second form that forms a second cavity when the fastener is opened in the second form. The apparatus further includes a sack containing filler material. The sack is sewn into the apparatus to help the apparatus keep its shape and to prevent or mitigate against the filler material escaping the sack. Additionally, the apparatus includes one or more concealing strips configured to conceal one or more of the first and second fasteners from view. The apparatus is invertible from the first form into the second form, and vice versa, via the first and second cavities, respectively.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

It will be readily understood that the components of various embodiments of the present invention, as generally described and illustrated in the figures herein, may be arranged and designed in a wide variety of different configurations. Thus, the following more detailed description of the embodiments of the apparatuses of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, the usage of "certain embodiments," "some embodiments," or other similar language, throughout this specification refers to the fact that a particular feature, structure, or characteristic described in connection with an embodiment may be included in at least one embodiment of the invention. Thus, appearances of the phrases "in certain embodiments," "in some embodiments," "in other embodiments," or other similar language, throughout this specification do not necessarily all refer to the same embodiment or group of embodiments, and the described features, structures, or characteristics may be combined in any suitable manner in one or more embodiments.

Some embodiments of the present invention pertain to a product (or unit) in the form of a pillow or cushion that is invertible from one form into another. The product starts in a first form that includes a fastener that is generally (but not necessarily) obscured from view on the underside or side of the first form. When the fastener is opened, the contents of the product can be extracted and inverted into the second form. It should be appreciated that the components of this product will be different based on design and safety compliance requirements, but the overall function of the product being convertible from a pillow or cushion into a character, figure, or whatever form is desired remains for many embodiments of the present invention. In fact, embodiments of the present invention may be converted from any first form to any second form, and vice versa.

It should also be appreciated that the product is not limited to a pillow or cushion, or to any shape, form, and/or size, as can be appreciated by a person of ordinary skill in the art. For instance, the product may be convertible from a square pillow into a plush dog toy, a baseball into a bat, any type of fruit into any other type of fruit, etc., by the process of inverting the product from one form into another form.

Figure 1:
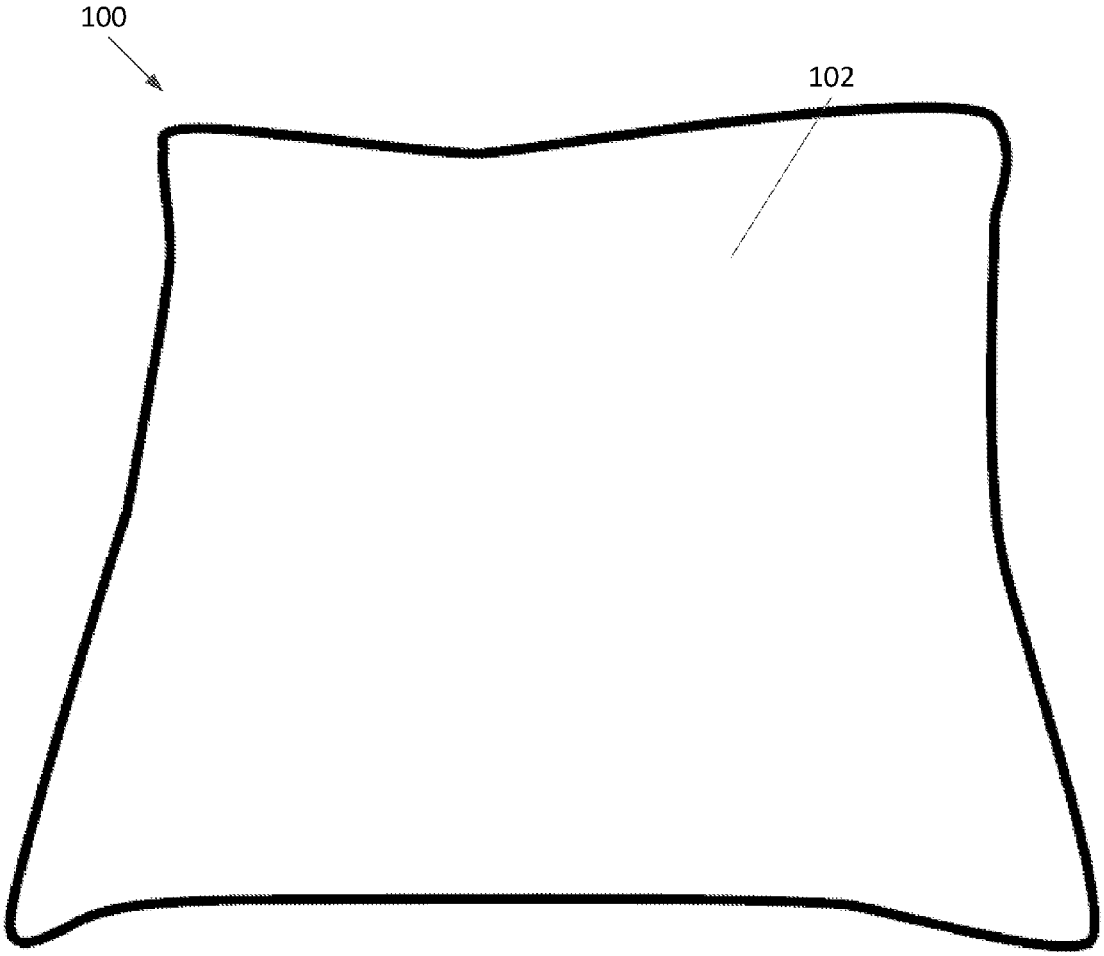
FIG. 1 illustrates a top view of a pillow in a first form prior to conversion into a second form, according to an embodiment of the present invention.

FIG. 1 illustrates a top view of a pillow 100 in a first form prior to conversion into a second form, according to an embodiment of the present invention. An exterior surface 102 of pillow 100 may be made from a plush fabric, but some embodiments may substitute other materials including, but not limited to, microfiber, cotton, or a cotton/polyester blend in both knitted and woven fabric. Pillow 100 may be stuffed with any suitable material including, but not limited to, cotton, beads, foam, pellets, balls, beans, leather, etc.

Figure 2:
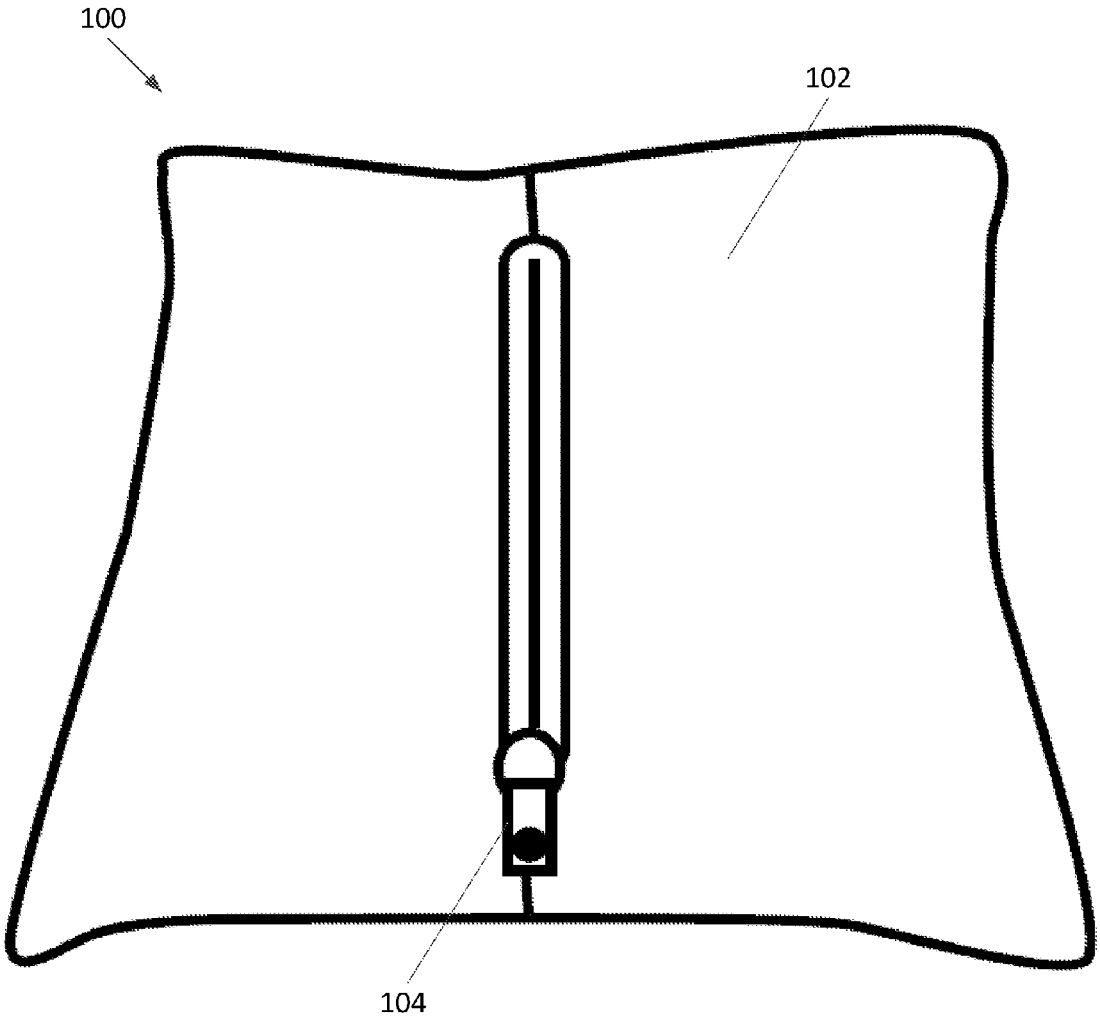
FIG. 2 illustrates a bottom view of a pillow in a first form prior to conversion into a second form, according to an embodiment of the present invention.

FIG. 2 illustrates a bottom view of pillow 100 in the first form prior to conversion into the second form, according to an embodiment of the present invention. Pillow 100 has a fastener 104 on the underside surface, but as noted above, the fastener may be placed in any desired location. In some embodiments, it is preferable for fastener 104 to be located on either the bottom or a side of pillow 100, depending on the requirements of the design and other compliance requirements, such as safety requirements.

While shown as a zipper in FIG. 2, fastener 104 can take any other suitable form, including a hook-and-loop fastener (such as Velcro®), snaps, clasps, buttons, or any other fastener that would be appreciated by a person of ordinary skill in the art. The type of fastener that is selected may be dictated by the requirements of the design and compliance with safety regulations, but the overall function will be to retain the interior of pillow 100 and any filler material within its cavity.

Fastener 104 can be attached to the fabric of pillow 100 by sewing or using an adhesive. Fastener 104 can also be attached by any manner that would be appreciated by a person of ordinary skill in the art. To provide the element of surprise and functionality, fastener 104 may be attached at a location that is not immediately obvious or visible when pillow 100 is handled.

Figure 3:
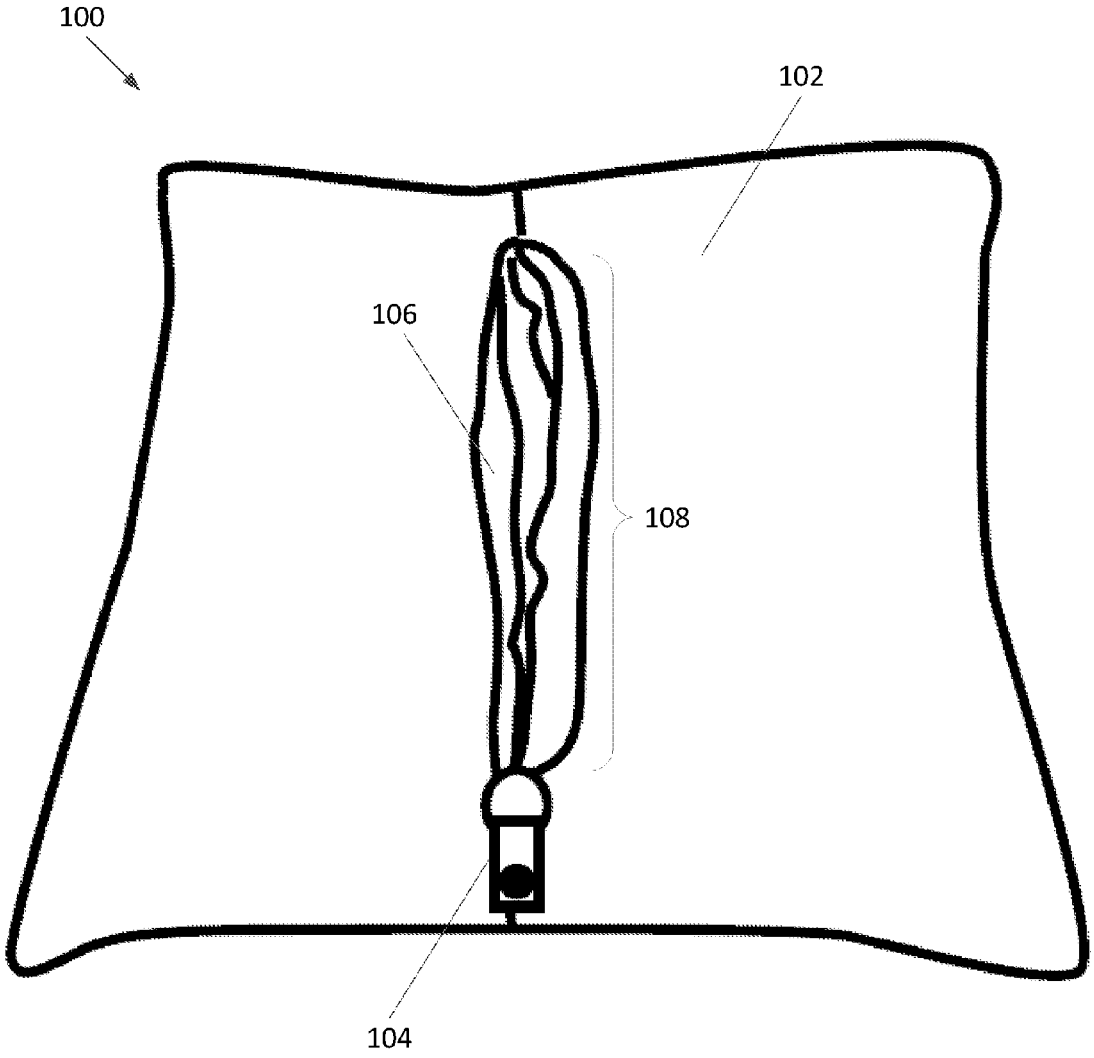
FIG. 3 illustrates another bottom view of a pillow in a first form where a fastener has been opened and the interior has been exposed, according to an embodiment of the present invention.

FIG. 3 illustrates another bottom view of pillow 100 in the first form where fastener 104 has been opened and an interior surface 106 has been exposed, according to an embodiment of the present invention. When fastener 104 is opened, interior surface 106 of the contents of a cavity 108 within pillow 100 are visible.

Figure 4:
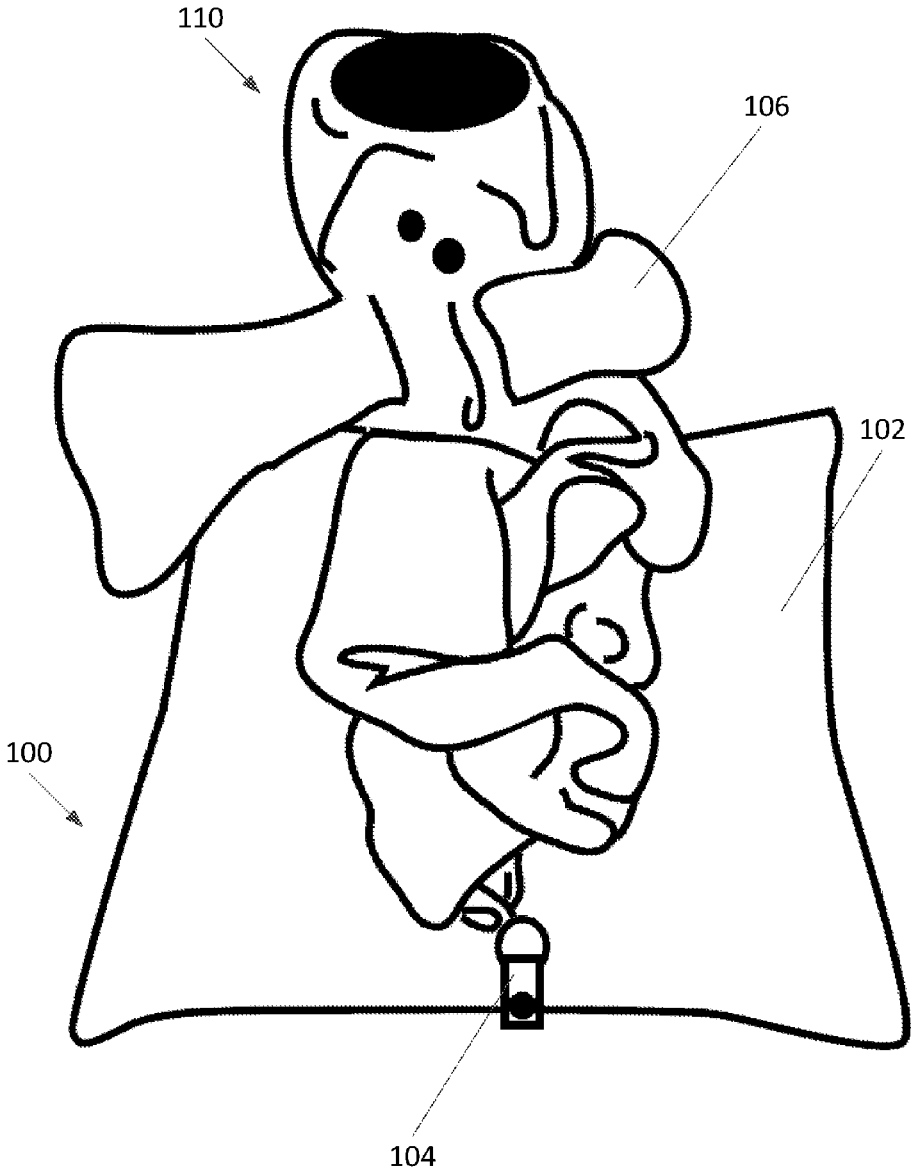
FIG. 4 illustrates yet another bottom view of a pillow where a plush toy constituting a second form is partially exposed, according to an embodiment of the present invention.

FIG. 4 illustrates yet another bottom view of pillow 100 where a plush toy 110 constituting the second form is partially exposed, according to an embodiment of the present invention. When fastener 104 is opened, the contents (plush toy 110) of cavity 108 from FIG. 3 (concealed by plush toy 110 in this view) that are within pillow 100 are drawn to the exterior, or extracted, from cavity 108. In some embodiments, a drawstring, handle, or any other suitable mechanism (not shown) may be attached to interior surface 106 of plush toy 110 to facilitate easier removal from cavity 108. In addition to, or in lieu of, this feature, a drawstring, handle, or any other suitable mechanism (not shown) may also be attached to exterior surface 102 of pillow 100 to facilitate easier removal thereof when converting from the second form to the first form.

Figure 5:
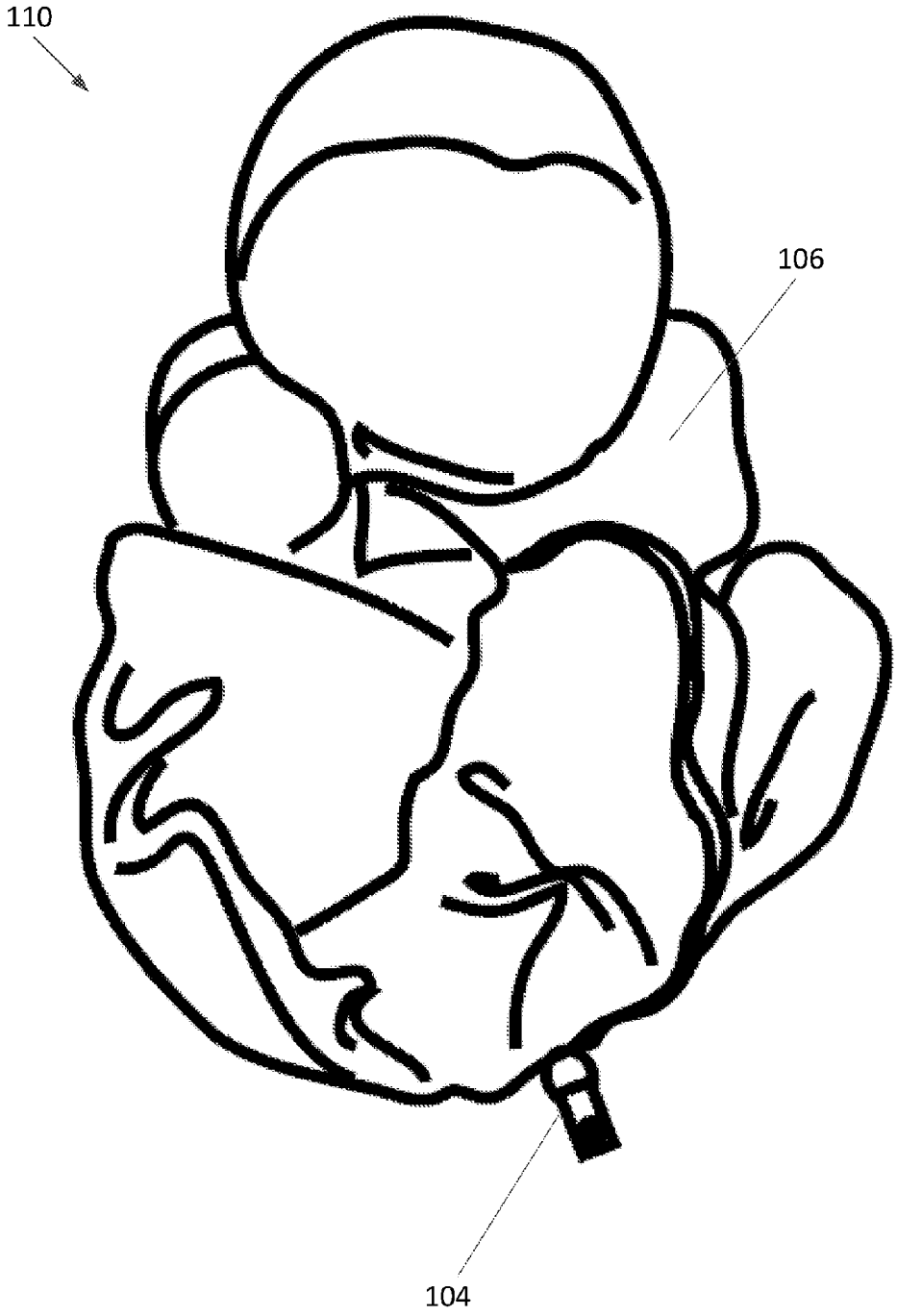
FIG. 5 illustrates a bottom view of a plush toy constituting a second form of a pillow, according to an embodiment of the present invention.

FIG. 5 illustrates a bottom view of plush toy 110 constituting the second form of pillow 100, according to an embodiment of the present invention. The fabric of pillow 100 has been inverted and the contents of cavity 108, which are plush toy 110, have been extracted and take the shape of a toy dog.

Figure 6:
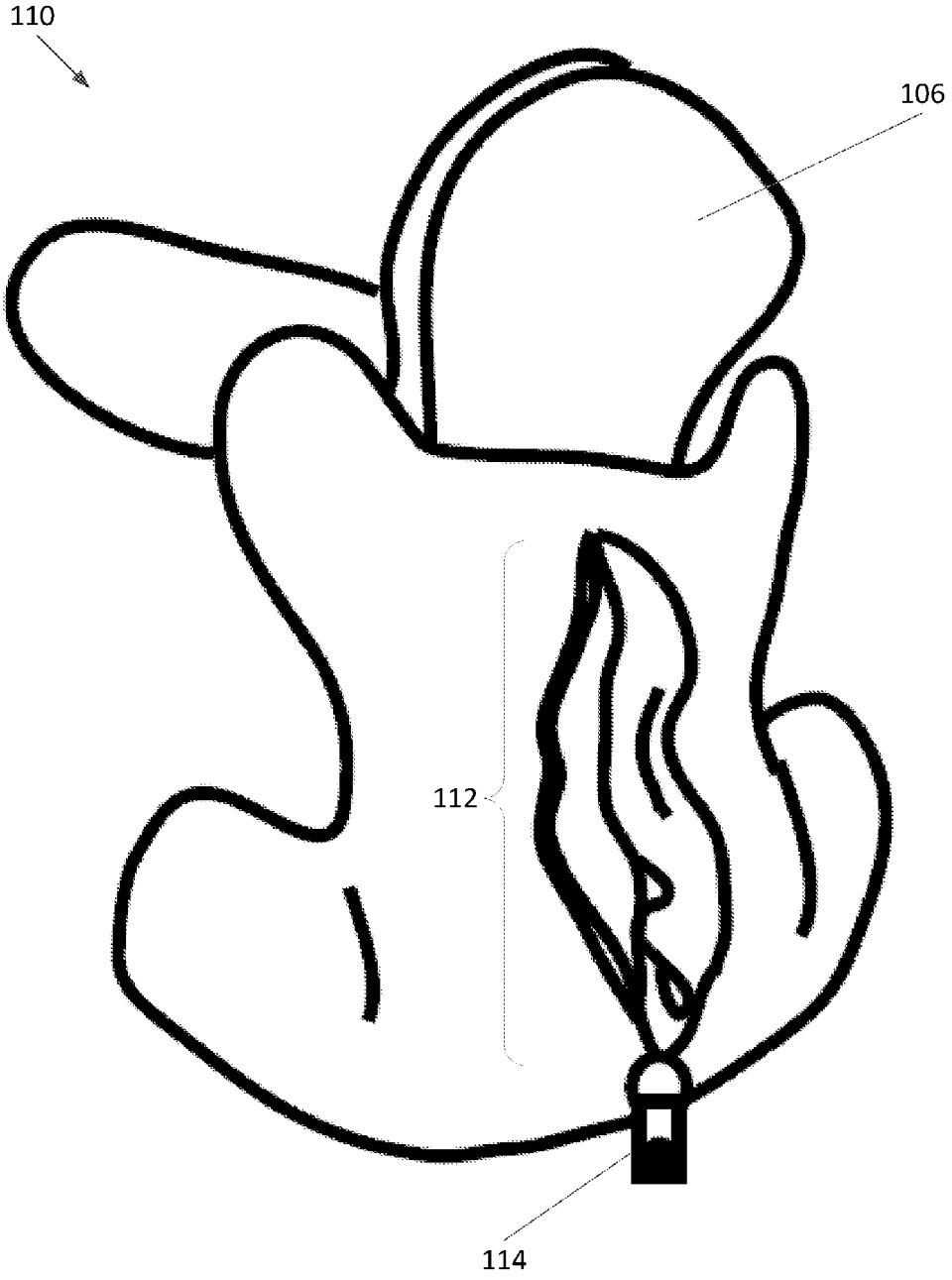
FIG. 6 illustrates another bottom view of a plush toy constituting a second form of a pillow, according to an embodiment of the present invention.

FIG. 6 illustrates another bottom view of plush toy 110 constituting the second form of pillow 100, according to an embodiment of the present invention. This second, or inverted, form has a corresponding fastener 114 and cavity 112, into which pillow 100 has been folded. Accordingly, two fasteners 104 and 114 are included that are placed on the blind side of pillow 100 and plush toy 110, respectively. In many embodiments, it may be preferable to place the fasteners on the underside or towards the side of the product so as to obscure them from view. Per the above, the fasteners are not limited to the underside or the side of the product, but can be placed in any location on the product that would be appreciated by a person of ordinary skill in the art. In some embodiments, a single fastener may be used, such as a single zipper that is accessible from both sides.

Fastener 104 is situated on the exterior of pillow 100 and fastener 114 is situated on the exterior of plush toy 110 (the interior of pillow 100) in mirroring positions. Whichever form that is taken, whether a pillow or a character, figure, etc., the fastener that is presently on the exterior relative to the user is the one that is closed so as to hold the components within the relevant one of cavities 108 or 112 in place.

Figure 7:
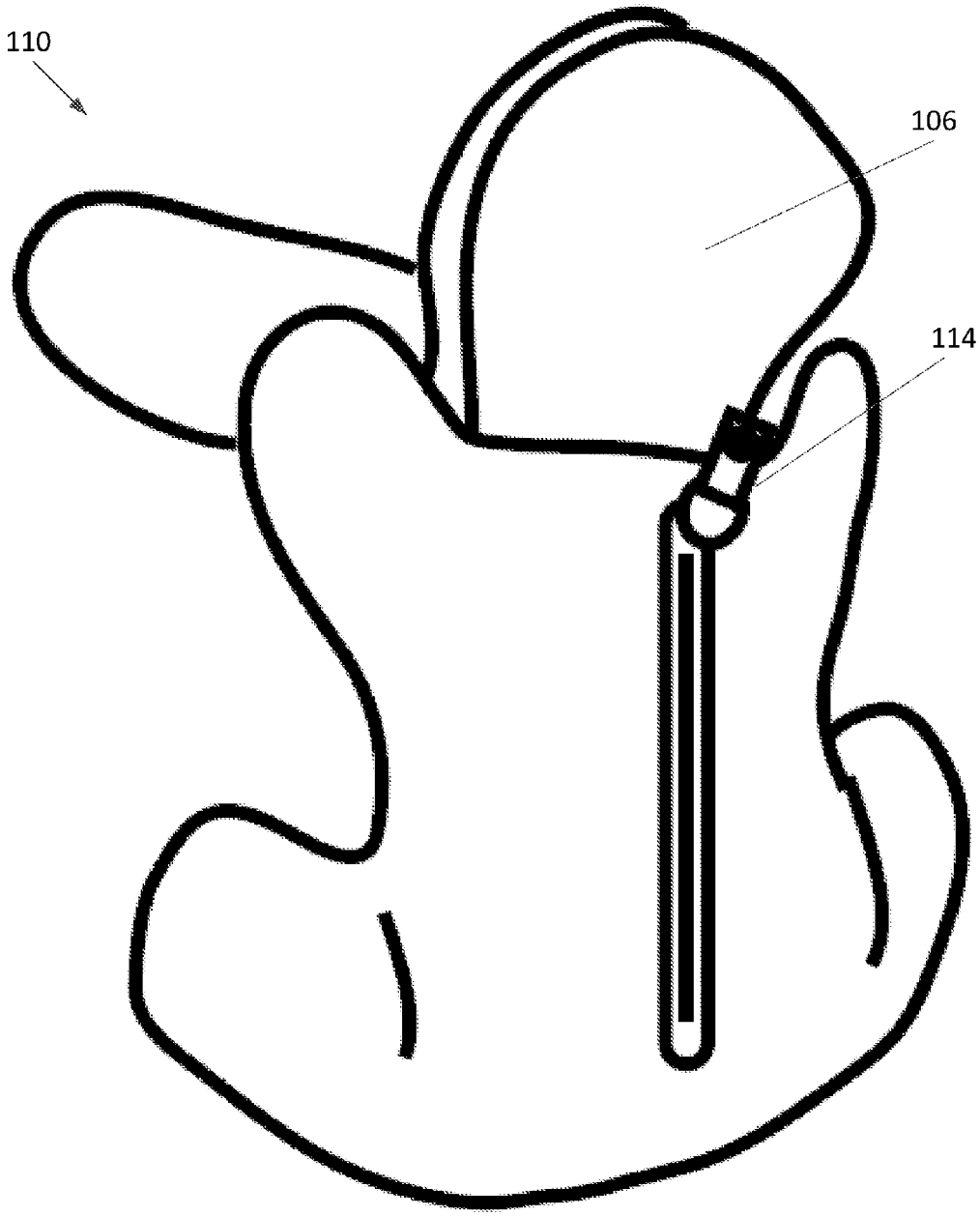
FIG. 7 illustrates yet another bottom view of a plush toy constituting a second form of a pillow, according to an embodiment of the present invention.
Figure 8:
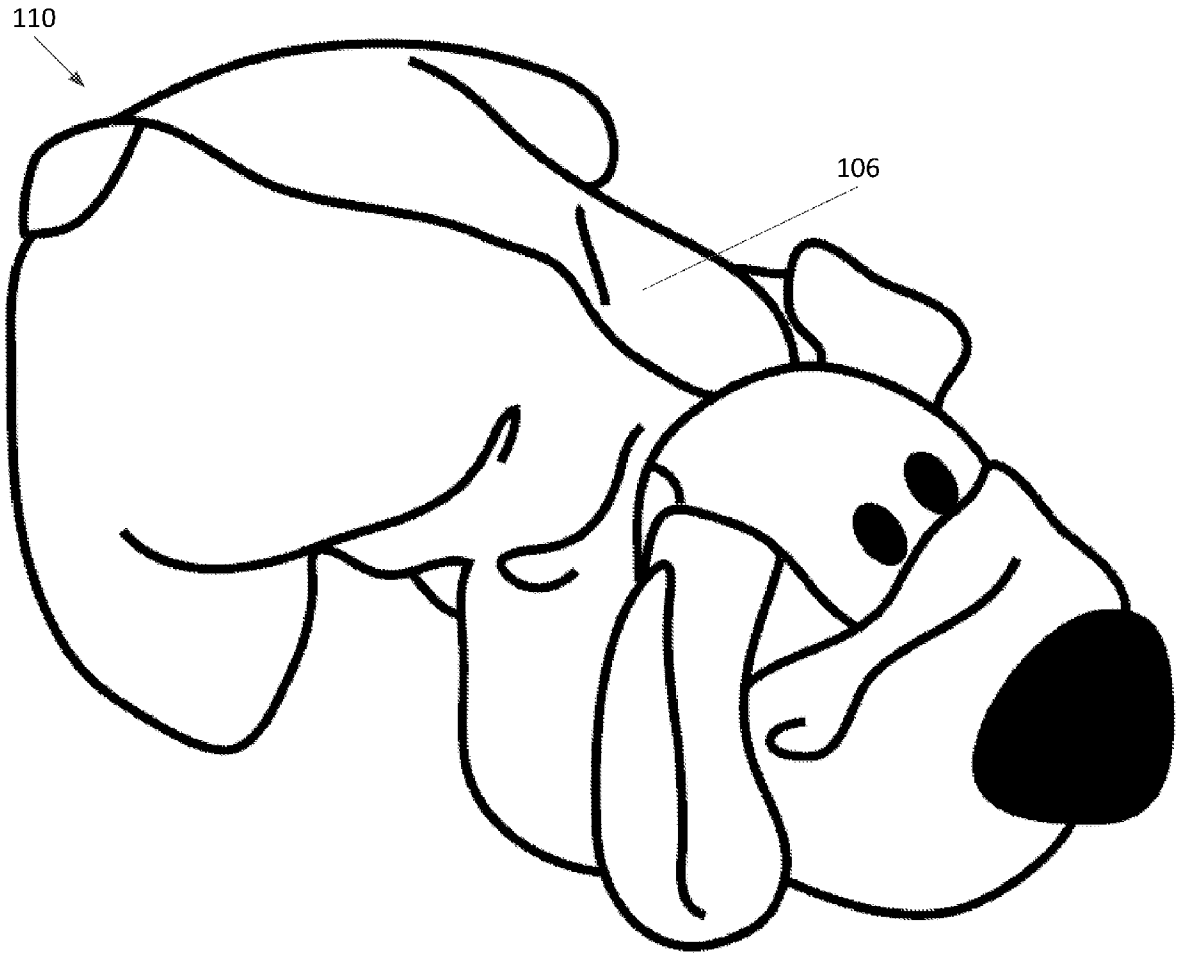
FIG. 8 illustrates a top view of a plush toy constituting a second form of a pillow, according to an embodiment of the present invention.

FIG. 7 illustrates yet another bottom view of plush toy 110 constituting the second form of pillow 100, according to an embodiment of the present invention. As can be seen, when fastener 114 is closed, pillow 100 disappears completely, and only plush toy 110 is visible. FIG. 8 illustrates a top view of plush toy 110 constituting the second form of pillow 100, according to an embodiment of the present invention. Fastener 114 is concealed from view, and plush toy 110 appears to be a normal stuffed dog toy.

Figure 9:
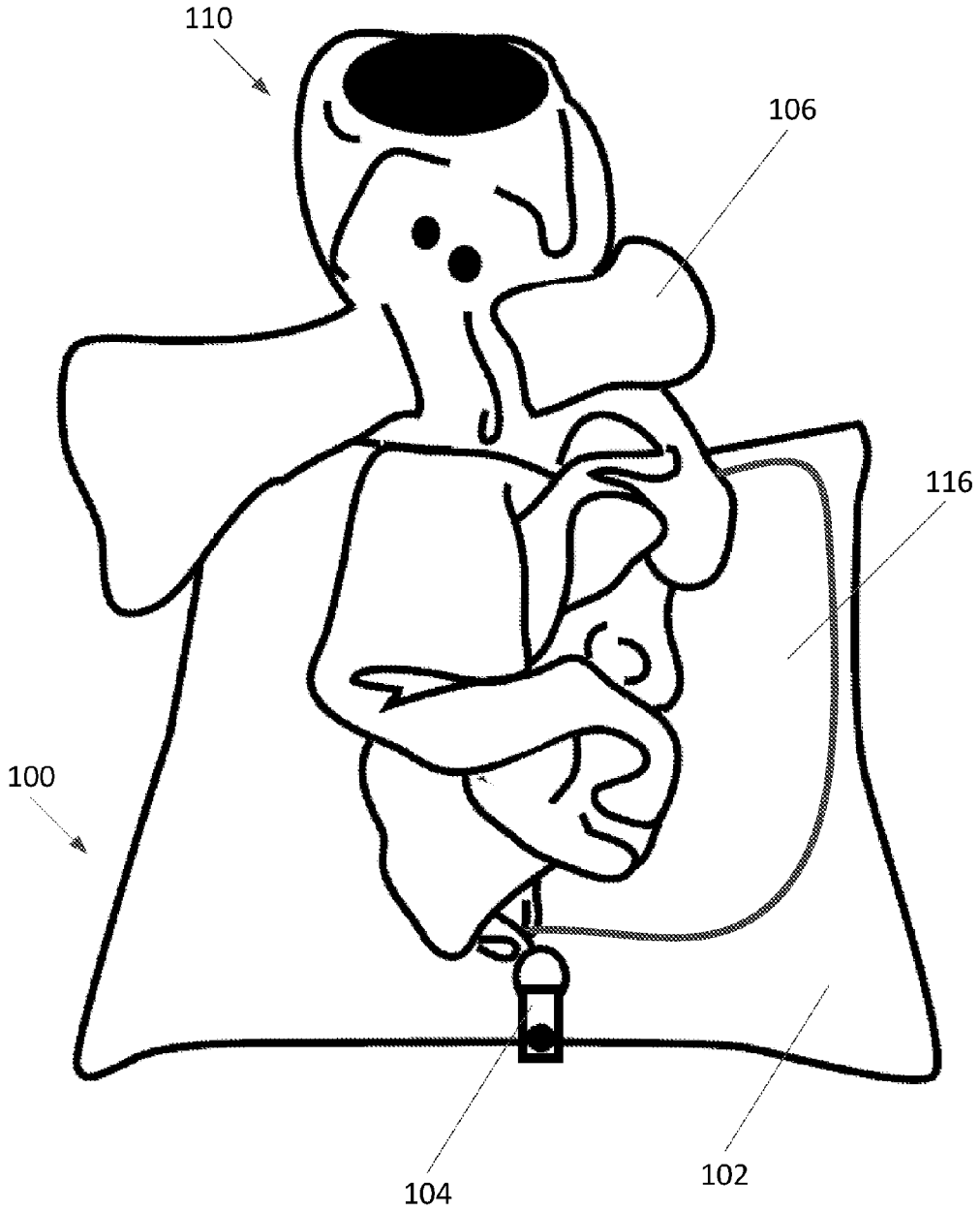
FIG. 9 illustrates a bottom view of a pillow where a plush toy constituting a second form is partially exposed and a sack is included, according to an embodiment of the present invention.

FIG. 9 illustrates a bottom view of pillow 100 where plush toy 110 constituting the second form is partially exposed and a sack 116 is included, according to an embodiment of the present invention. As seen in FIG. 9, pillow 110 includes a lining in the form of sack 116 that houses the filling of the product, allowing it to take shape accordingly. The sack prevents or mitigates against the filling from falling out of pillow 100 or plush toy 110. In some embodiments, multiple sacks may be included, and sacks may take different shapes and forms and be placed at different locations within the product, depending on design.

Figure 10A:
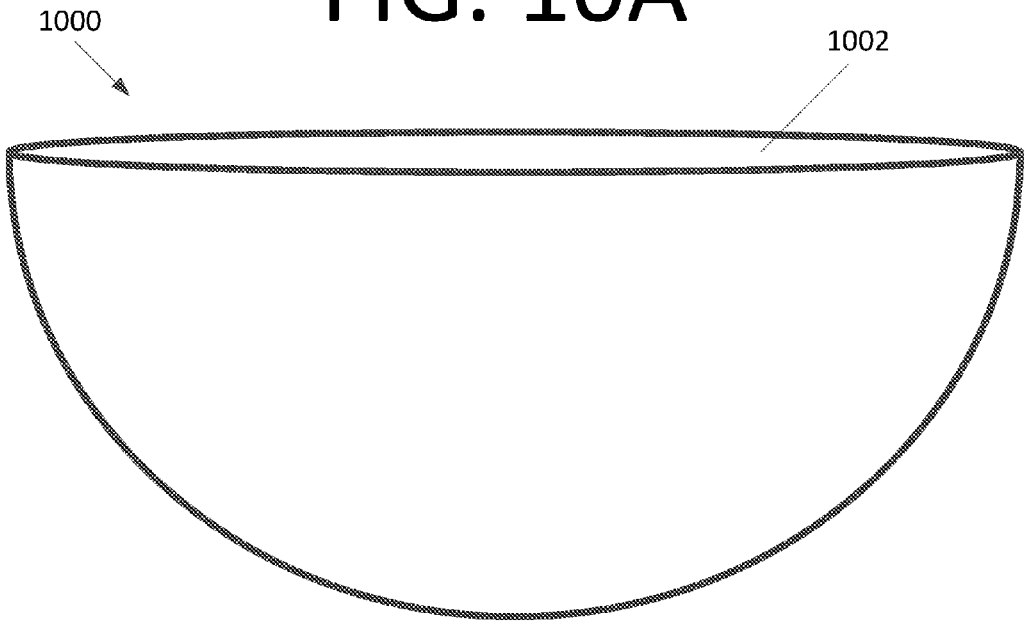
FIG. 10A illustrates a semicircular sack, according to an embodiment of the present invention.

FIG. 10A illustrates a semicircular sack 1000, according to an embodiment of the present invention. Sack 1000 is shown prior to insertion of filling via opening 1002 and sack 1000 being sewn into the product. In some embodiments, sack 1000 may have multiple compartments (not visible) that are filled with different amounts of filling material.

Figure 10B:
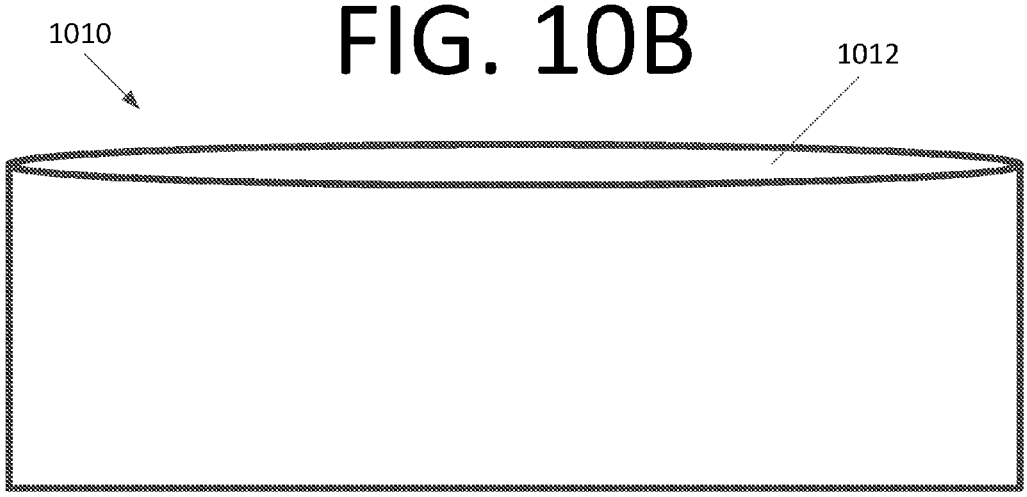
FIG. 10B illustrates a rectangular sack, according to an embodiment of the present invention.

FIG. 10B illustrates a rectangular sack 1010, according to an embodiment of the present invention. Sack 1010 is shown prior to insertion of filling via opening 1012 and sack 1010 being sewn into the product.

A person of ordinary skill in the art will appreciate that the sack shown in FIGS. 10A and 10B is not limited to a semi-circular sack or a rectangular sack, but may be a sack with any shape, size, or form.

Figure 11:
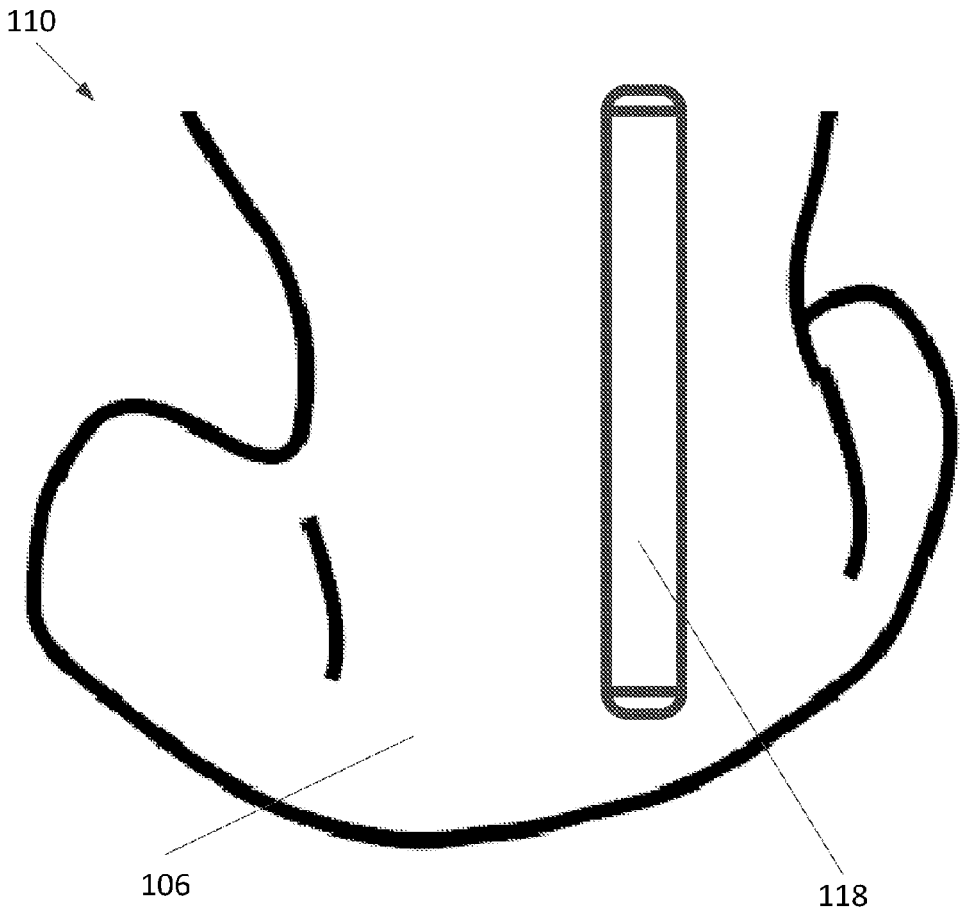
FIG. 11 illustrates a bottom view of a plush toy constituting a second form of a pillow including a concealing strip, according to an embodiment of the present invention.

FIG. 11 illustrates a bottom view of plush toy 110 constituting the second form of pillow 100 with a concealing strip 118, according to an embodiment of the present invention. Concealing strip 118 conceals fastener 114, and a similar concealing strip may also be present to conceal fastener 104 on pillow 100. Concealing strip 118 may be a cloth that is not sewn in on all sides and may include a hook-and-loop fastener (in which case the hooks or loops would be sewn as a second strip on plush toy 110), buttons, snaps, hooks, or any other suitable mechanism.

The elements of the product illustrated in FIGS. 1-11 may be knitted or woven fabrics that form a pillow or cushion shell, as well as a character into which the pillow or cushion converts. Fastener 104, when closed, holds plush toy 110 in cavity 108 of pillow 100. Similarly, fastener 114, when closed, holds pillow 100 in cavity 112 of plush toy 110. In the embodiment depicted in the figures, the product may be initially used as a functioning pillow on which a person can use in the same manner as a normal pillow or cushion. In toy form, the product appears as a stuffed animal. Embodiments of the present invention can be used in daycare centers, hospice facilities, any home environment to function both as a pillow for comfort and rest, and also as a plush toy to provide entertainment, comfort and security.

In some embodiments of the present invention, a textile product is invertible from a first form into a second form, and vice versa. The forms may take any desired shape. A single fastener, or multiple fasteners, may be used to create a cavity through which the (currently) interior surface of the textile product may be pulled or extracted. Naturally, this process also works in the inverse.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but does not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with features in a different order, and/or with elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. An apparatus, comprising:

an external surface of a first form comprising a first fastener that forms a first cavity when opened;

an internal surface of a second form comprising a second fastener that forms a second cavity when opened; and a sack containing filler material that is separate from the external surface and internal surface, the sack sewn into the apparatus such that the sack is configured to help the apparatus keep its shape and to prevent or mitigate against filler material escaping from the sack or from the apparatus, wherein the apparatus is invertible from the first form into the second form, and vice versa, via the first and second cavities, respectively.

2. The apparatus of claim 1, wherein the apparatus takes a first form when the external surface has been sufficiently removed from the second cavity, and the apparatus takes a second form when the internal surface has been sufficiently removed from the first cavity.

3. The apparatus of claim 1, wherein the first form comprises a pillow or cushion and the second form comprises a plush toy.

4. The apparatus of claim 1, wherein the first form comprises a first article and the second form comprises a second, related article.

5. The apparatus of claim 1, wherein the first and second fasteners are located on an underside or a side of the apparatus, thereby obscuring the first and second fasteners from view.

6. The apparatus of claim 1, further comprising:

one or more concealing strips configured to conceal one or more of the first and second fasteners from view.

7. The apparatus of claim 1, wherein the apparatus comprises a plurality of sacks having different shapes and forms, the sacks placed at different locations within the apparatus.

8. The apparatus of claim 1, wherein the sack comprises a plurality of compartments, each compartment having different amounts of filling material.

9. An apparatus, comprising:

an external surface of a first form comprising a fastener that forms a first cavity when opened in the first form;

an internal surface of a second form that forms a second cavity when the fastener is opened in the second form; and a sack containing filler material that is separate from the external surface and internal surface, the sack sewn into the apparatus such that the sack is configured to help the apparatus keep its shape and to prevent or mitigate against filler material escaping, from the sack or from the apparatus, wherein the apparatus is invertible from the first form into the second form, and vice versa, via the first and second cavities, respectively.

10. The apparatus of claim 9, wherein the apparatus takes a first form when the external surface has been sufficiently removed from the second cavity, and the apparatus takes a second form when the internal surface has been sufficiently removed from the first cavity.

11. The apparatus of claim 9, wherein the first form comprises a pillow or cushion and the second form comprises a plush toy.

12. The apparatus of claim 9, wherein the first form comprises a first article and the second form comprises a second, related article.

13. The apparatus of claim 9, wherein the fastener is located on an underside or a side of the apparatus, thereby obscuring the fastener from view.

14. The apparatus of claim 9, further comprising:

one or more concealing strips configured to conceal one or more of the first and second fasteners from view.

15. A textile product, comprising:

an external surface of a first form comprising a fastener that forms a first cavity when opened in the first form;

an internal surface of a second form that forms a second cavity when the fastener is opened in the second form;

a sack containing filler material that is separate from the external surface and internal surface, wherein the sack is sewn into the apparatus such that the sack is configured to help the apparatus keep its shape and to prevent or mitigate against the filler material escaping from the sack or from the apparatus; and one or more concealing strips configured to conceal one or more of the first and second fasteners from view, wherein the apparatus is invertible from the first form into the second form, and vice versa, via the first and second cavities, respectively.

16. The product of claim 15, wherein the apparatus takes a first form when the external surface has been sufficiently removed from the second cavity, and the apparatus takes a second form when the internal surface has been sufficiently removed from the first cavity.

17. The product of claim 15, wherein the first form comprises a pillow or cushion and the second form comprises a plush toy.

18. The product of claim 15, wherein the first form comprises a first article and the second form comprises a second, related article.

19. The product of claim 15, wherein the fastener is located on an underside or a side of the apparatus, thereby obscuring the fastener from view.

20. The product of claim 15, wherein the sack has a semicircular or rectangular form.

* * * * *